US008714416B2

(12) United States Patent
Becker

(10) Patent No.: US 8,714,416 B2
(45) Date of Patent: May 6, 2014

(54) SPRAY CAN HANDLE ATTACHMENT AND METHOD OF USING

(76) Inventor: Kenneth Jay Becker, Talent, OR (US)

( * ) Notice: Subject to any disclaimer, the term of this patent is extended or adjusted under 35 U.S.C. 154(b) by 103 days.

(21) Appl. No.: 13/297,821

(22) Filed: Nov. 16, 2011

(65) Prior Publication Data

US 2012/0292337 A1 Nov. 22, 2012

Related U.S. Application Data

(63) Continuation-in-part of application No. 12/394,680, filed on Feb. 27, 2009, now Pat. No. 8,272,542.

(60) Provisional application No. 61/414,456, filed on Nov. 17, 2010.

(51) Int. Cl.
*B65D 83/00* (2006.01)
*B65D 83/16* (2006.01)

(52) U.S. Cl.
USPC ..... 222/402.13; 222/402.15; 222/323; 222/473; 222/1

(58) Field of Classification Search
USPC ..... 222/402.13, 402.15, 323, 473, 1
See application file for complete search history.

(56) References Cited

U.S. PATENT DOCUMENTS

| | | | | |
|---|---|---|---|---|
| 1,970,631 | A * | 8/1934 | Sherman | 222/498 |
| 3,189,232 | A * | 6/1965 | Joffe | 222/402.13 |
| 3,506,159 | A * | 4/1970 | Muller | 222/135 |
| 8,052,015 | B2 * | 11/2011 | Huang | 222/402.15 |
| 2008/0054025 | A1 * | 3/2008 | Tsai | 222/402.15 |

FOREIGN PATENT DOCUMENTS

| | | | | |
|---|---|---|---|---|
| GB | 2218471 | A * | 11/1989 | 222/402.13 |

* cited by examiner

*Primary Examiner* — Kevin P Shaver
*Assistant Examiner* — Nicholas J Weiss
(74) *Attorney, Agent, or Firm* — Hartman Global IP Law; Gary M. Hartman; Domenica N. S. Hartman

(57) ABSTRACT

A handle attachment configured to provide a secure handle for a spray can and enable the operation of a dispenser valve of the spray can. The attachment includes a housing that defines a grip, a cap coupled to the housing, and an actuation device pivotally mounted to the housing. The cap has a C-shaped rim surrounding an opening that is sized to accommodate a valve mounting cup of the spray can. The rim has a lower portion in which a flange and slots are defined. The slots enable the lower portion of the rim to deflect radially outward relative to the remainder of the rim above the slots. The rigidity of the rim above its lower portion is increased with a ring that compresses the rim above the lower portion and/or a shoulder that defines an increased wall thickness of the cap above the lower portion.

20 Claims, 5 Drawing Sheets

SPRAY CAN HANDLE ATTACHMENT AND METHOD OF USING

CROSS REFERENCE TO RELATED APPLICATIONS

This application claims the benefit of U.S. Provisional Application No. 61/414,456, filed Nov. 17, 2010, and is a continuation-in-part application of co-pending U.S. patent application Ser. No. 12/394,680, filed Feb. 27, 2009. The contents of these prior applications are incorporated herein by reference.

BACKGROUND OF THE INVENTION

The present invention generally relates to attachments capable of being mounted on an aerosol spray can to provide a secure handle and operate a push-type dispenser valve on the spray can.

Various spray can attachments are known that are intended to have the dual benefit of providing a convenient grip and actuating a push-type dispenser valve to dispense the contents of an aerosol spray can. One such approach involves an attachment capable of coupling to the valve mounting cup of a conventional spray can. One approach is to configure the attachment to be secured directly to what is termed the valve mounting cup, which surrounds the dispenser valve.

One such spray can attachment is disclosed in U.S. Pat. No. 4,432,474, a commercial embodiment of which is known as the "CAN-GUN." The attachment method of the CAN-GUN involves a V-shaped feature that snaps within an annular channel defined by the inner perimeter of a standard valve mounting cup. The CAN-GUN includes an integral shield and an ergonomic four-finger pistol grip, and the grip including the part defining the inverted V-shaped feature can be formed of 100% reprocessed or virgin polypropylene copolymer in a one-shot mold process. The CAN-GUN further includes a trigger that operates the dispenser valve by pressing downwardly on the top of the valve. A key feature of the CAN-GUN is that it is easier to operate the valve with the trigger than to press and maintain pressure on the valve with a finger. Any competitive product of the CAN-GUN would preferably retain these features, as well as be easily and securely attachable to and removable from a valve mounting cup.

Related U.S. patent application Ser. No. 12/394,680 to Becker, published as US 2010/0051652, discloses a spray can handle attachment that retains the advantageous operational aspects of the CAN-GUN. Two figures of the Becker application are attached as FIGS. 1 and 2. The handle attachment, currently being commercially sold under the name CanGun1®, is capable of being mounted to a standardized valve mounting cup of a conventional aerosol spray can. Similar to the CAN-GUN, the CanGun1® provides a secure handle and enables the operation of a push-type dispenser valve of a spray can. However, in contrast to the CAN-GUN, the CanGun1® is configured for mounting to the exterior of the valve mounting cup by means of a resilient compression or capture feature.

As represented in FIGS. 1 and 2, the CanGun1® is configured as an attachment 10 that comprises a two-piece housing 12 with housing halves 12A and 12B. The housing 12 defines a grip 14, a neck 16, a cylindrical-shaped coupling cap 18, and a four-finger ergonomic trigger 20 configured to pivot on a post within the housing 12. The trigger 20 is part of an arm that terminates with a finger (not shown) that protrudes into the interior of the cap 18 and moves in a roughly axial direction of the coupling cap 18 when the trigger 20 is actuated relative to the attachment grip 14. By squeezing the trigger 20, the finger is able to depress a push-type dispenser valve 31 of the spray can 30 (FIG. 1). The location of the pivot post preferably provides a mechanical advantage of about 2.5:1 or more between the trigger 20 and the finger, meaning that the attachment 10 greatly decreases the amount of force required at the trigger 20 to actuate a dispenser valve. The coupling cap 18 can be integrally molded with one of the housing halves 12A or 12B, in which case the other housing half 12A/12*b* is simultaneously connected to the cap 18 when the halves 12A and 12B are assembled.

The cap 18 has a C-shaped lower rim 26 with a pair of slots 28 (FIG. 2) that, in combination, enable the cap 18 to snap onto and grip the outer circumference of a valve mounting cup 32 of a spray can 30, as depicted in FIG. 1. The rim 26 and its slots 28 provide a resilient compression or capture feature that enables the attachment 10 to be readily snapped onto the valve mounting cup 32 and thereafter remain secured during use of the attachment 10 to dispense the contents of the can 30. As evident in FIGS. 1 and 2, the C-shaped configuration of the rim 26 defines a circumferential gap 27 (FIG. 2) that is contiguous with a window 34 formed at the front of the cap 18. As evident from FIG. 1, this window 34 provides an aperture through which the contents of the spray can 30 are dispensed through the cap 18. With the exception of the circumferential gap 27, the rim 26 has a flange 36 that extends radially inward to define a central circular opening 38 sized to provide an interference fit with the valve mounting cup 32 of the can 30.

The slots 28 are circumferentially located approximately ninety degrees from each other and from the circumferential gap 27, and pass entirely through the flange 36 of the rim 26. Furthermore, the slots 28 are oriented to be roughly collinear with each other, perpendicular to the axis of symmetry of the rim 26, and lying on a nondiametrical chord located roughly midway between the base of the rim 26 (diametrically opposite the gap 27) and a diametrical chord perpendicular to the rim's axis of symmetry. As such, each slot 28 is closer to the base of the C-shape of the rim 26 than to the ends of the rim 26 separated by the rim gap 27. The cap 18 configured with the C-shaped rim 26 and the slots 28 located and oriented as shown in FIGS. 1 and 2 is both readily securable to a valve mounting cup 32 without the need for excessive force, yet reliably retained on the cup 32 during use of the attachment 10 to dispense the contents of an aerosol can 30.

With the configuration described above, the CanGun1® spray can handle attachment has proven to be very effective and successful for use with the vast majority of aerosol spray cans that have a net weight of up to eighteen ounces (about 510 grams). However, heavier spray cans may pose a challenge due to the desire to be able to secure and lift the cans with the handle attachment while dispensing the contents of these cans with the attachment.

BRIEF DESCRIPTION OF THE INVENTION

The present invention provides a handle attachment configured to be mounted to a standardized valve mounting cup of a conventional aerosol spray can, and specifically to the exterior of the valve mounting cup by means of a resilient compression or capture feature, to provide a secure handle and enable the operation of a dispenser valve of the spray can. The attachment is also configured to be effective for securing and lifting aerosol spray cans that have a net weight in excess of eighteen ounces (about 510 grams).

According to a first aspect of the invention, the spray can handle attachment includes a housing defining a grip, a cap coupled to the housing, and an actuation device pivotally mounted to the housing. The cap has a lower end that defines a C-shaped rim and an opening surrounded by the rim. The rim has an axis of symmetry, a base located on the axis of symmetry, and a circumferential gap located on the axis of symmetry diametrically opposite the base and separating two ends of the rim. The opening is sized to accommodate an outer diameter of the valve mounting cup. The rim has a lower portion in which a flange and slots are defined. The flange has an interference fit with the valve mounting cup, and the slots enable the lower portion of the rim to deflect radially outward relative to a remaining upper extent of the rim above the slots. The actuation device has a trigger portion disposed adjacent the grip and a finger portion that projects into the cap for actuating the dispenser valve of the spray can in response to movement of the trigger portion relative to the grip of the housing. The attachment further includes means for increasing the rigidity of the rim above the lower portion thereof. According to preferred aspects of the invention, the rigidity increasing means is a ring that compresses the rim above the lower portion thereof and/or a shoulder that defines an increased wall thickness of the cap above the lower portion of the rim.

Another aspect of the invention is a method of using a spray can handle attachment comprising the elements described above. Such a method includes installing the attachment on the valve mounting cup of the spay can so that the opening of the rim receives the outer diameter of the valve mounting cup and the flange of the rim has an interference fit with the valve mounting cup. The spray can is then lifted with the grip of the attachment, after which the dispenser valve of the spray can is actuated by moving the trigger portion relative to the grip.

A technical effect of the invention is the ability of the handle attachment to be easily installed on relatively large and heavy sprays can with an amount of effort that is within the capability of a person with limited strength and dexterity, while also remaining securely attached to the spray can during use, including lifting the spray can and operating a disperse valve of the spray can.

Other aspects and advantages of this invention will be better appreciated from the following detailed description.

DETAILED DESCRIPTION OF THE INVENTION

The preferred aspect of the present invention is to provide spray can handle attachments that are capable of retaining the functionality and versatility of the CanGun1® spray can handle attachment disclosed in U.S. patent application Ser. No. 12/394,680 and shown in FIGS. 1 and 2, but also having the capacity to be able to attach to and lift a spray can whose net weight may significantly exceed eighteen ounces (510 grams). In particular, the handle attachments of this invention incorporate supplemental design features that provide a secure fit and function for aerosol cans having net weights of eighteen ounces (510 grams) or more.

Figure 3:
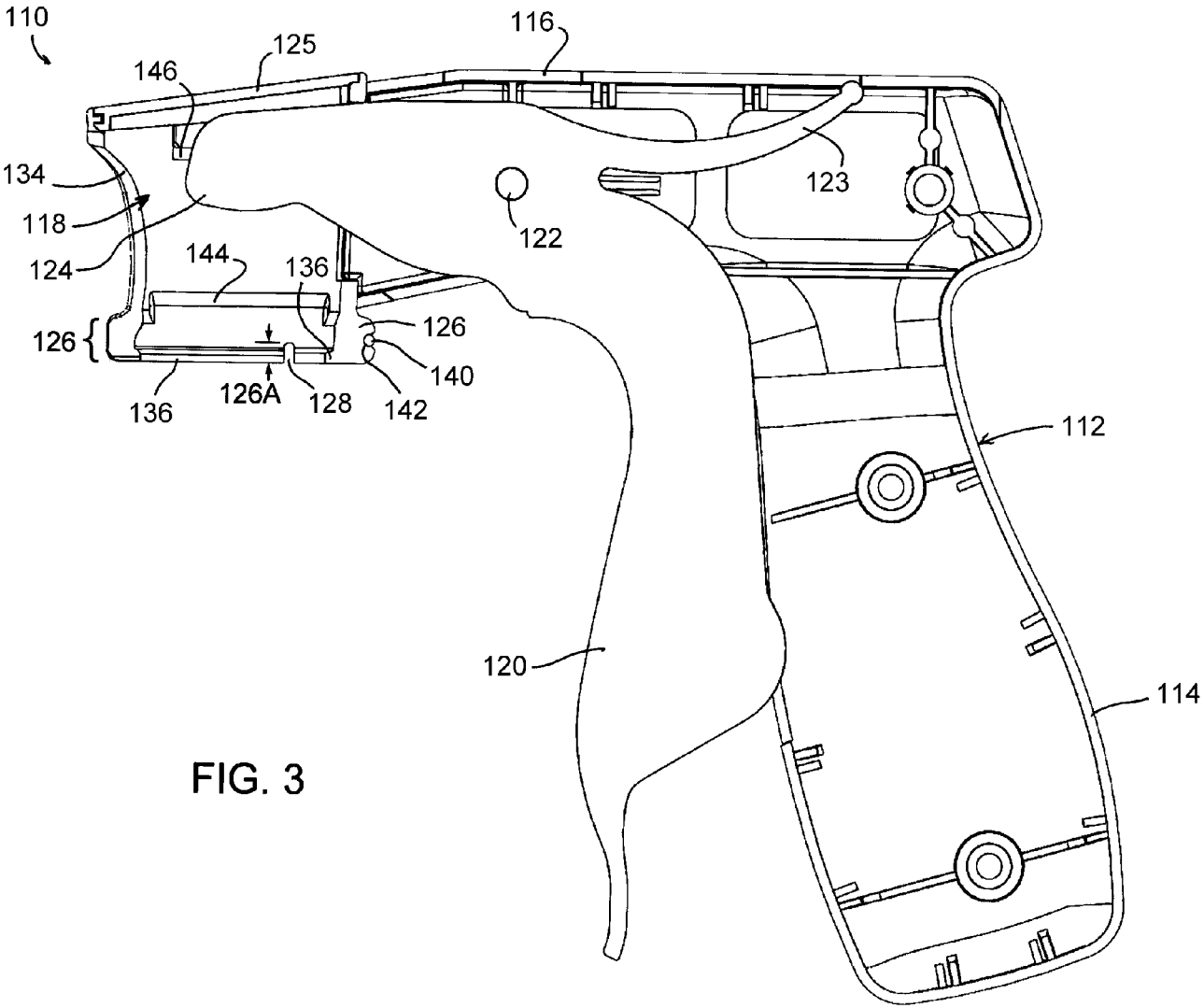
FIGS. 3 and 4 are side views of two spray can handle attachments configured in accordance with embodiments of the present invention, showing lefthand housing halves of the attachments removed and axial sections through coupling caps of the attachments.
Figure 4:
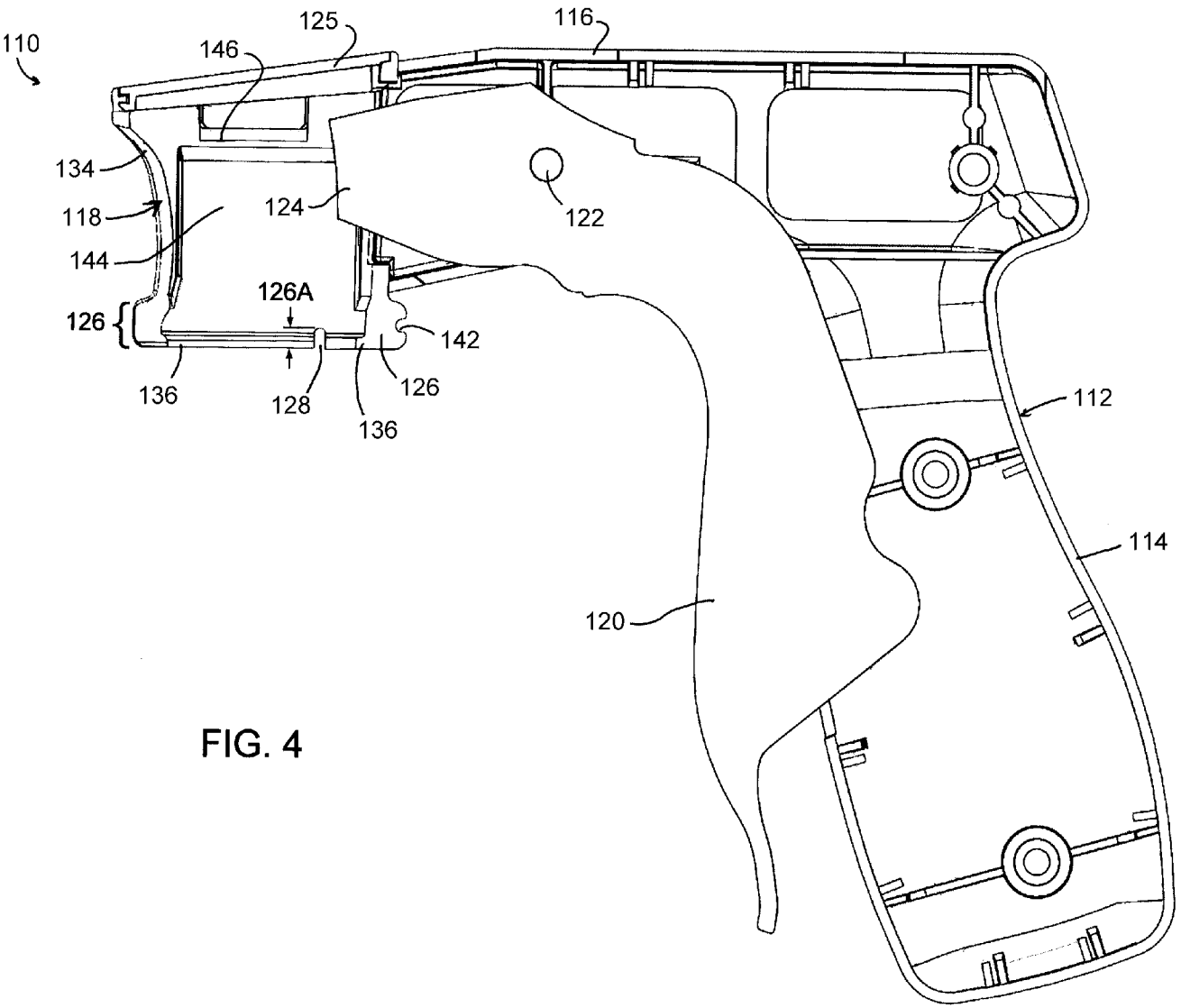

Two embodiments of handle attachments 110 of the present invention are represented in FIGS. 3 and 4. To facilitate the following description of the attachments 110, the terms "vertical," "horizontal," "lateral," "front," "rear," "side," "forward," "rearward," "upper," "lower," "above," "below," "right," "left," etc., will be used in reference to the perspective of an operator during the operation the attachment, and therefore are relative terms and should not be otherwise interpreted as limitations to the construction of the attachments or as limiting the scope of the invention.

Figure 1:
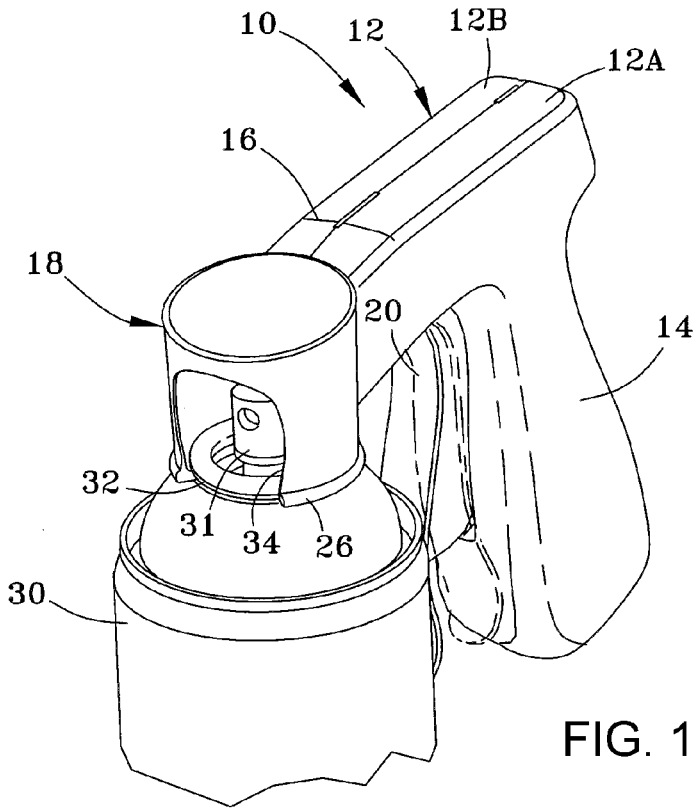
FIG. 1 is a perspective view of a spray can handle attachment secured to a valve mounting cup of a conventional aerosol spray can.
Figure 2:
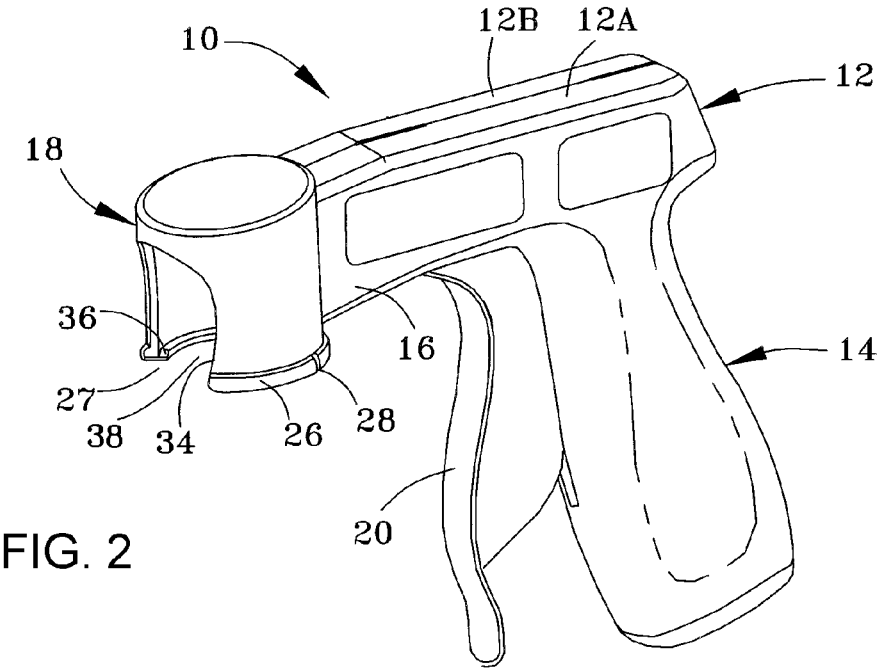
FIG. 2 is a perspective view of the spray can handle attachment of FIG. 1 removed from the spray can.

Each of the handle attachments 110 are similar to the CanGun1® handle attachment shown in FIGS. 1 and 2, which will therefore be referred to when describing certain attributes and characteristics of the handle attachments 110. For convenience, consistent reference numbers are used to identify the same or functionally equivalent elements, but with the numerical prefix "1" added to distinguish the embodiments of FIGS. 3 through 5 from the attachment 10 of FIGS. 1 and 2. As such, and as with the CanGun1® attachment 10 of FIGS. 1 and 2, each attachment 110 of the present invention comprises a two-piece housing assembly 112. FIGS. 3 and 4 show the left half of each housing assembly 112 as being absent to reveal the internal components within the assembly 112. Each housing assembly 112 defines a grip 114, a neck 116, and a cylindrical-shaped coupling cap 118. In the embodiments shown, each of the right and left housing halves defines one half of the grip 114 and neck 116, whereas the entire cap 118 is formed entirely separately and then attached to the housing assembly 112. Alternatively, one half (e.g., the right housing half) could be molded to define one half of the grip 114 and neck 116 and the entire cap 118, in which case the other housing half would be molded to define the remaining half of the grip 114 and neck 116. The cap 118 and the housing assembly 112 can be formed using an injection molding technique or some other suitable process. Preferred materials for the housing assembly 112 and cap 118 are 100% reprocessed or virgin polypropylene copolymer, a suitable commercial example of which is a Proline PPC-0320 commercial grade 100% polypropylene copolymer available from Shannon Industrial Corporation.

Each attachment 110 is further shown as equipped with a trigger 120 configured to pivot on a post 122 within the housing assembly 112. The trigger 120 is part of an arm that terminates with a finger 124 that protrudes into the interior of the coupling cap 118 and moves in either a roughly axial or radial direction of the coupling cap 118 when the trigger 120 is actuated relative to the attachment grip 114. In FIG. 3, squeezing the trigger 120 causes the finger 124 to move roughly axially, enabling the finger 124 to depress a push-type dispenser valve of the type shown in FIG. 1. The trigger 120 of FIG. 3 is further equipped with an integral cantilevered spring 123 that causes the trigger 120 to be biased away from the grip 114 and causes the finger 124 to be biased upward within the cap 118 and, therefore, away from a push-type dispenser valve such as that of the spray can 30 depicted in FIG. 1. The trigger 120 represented in FIG. 4 is configured so that squeezing the trigger 120 causes the finger 124 to have sufficient movement in the radial direction of the cap 118 to enable the finger 124 to also push a dispenser valve off-axis, in accordance with the operating mode of certain types of known dispenser valves. The attachments 110 of FIGS. 3 and 4 can be configured to have either type of operating action. The locations of the pivot post 122 in FIGS. 3 and 4 relative to the triggers 120 and fingers 124 preferably provide a mechanical advantage of about 2.5:1 or more between the trigger 120 and the finger 124, with the result that the attachment 110 greatly decreases the amount of force required at the trigger 120 to actuate a dispenser valve. In addition, the trigger 120 has a four-finger ergonomic design so that, when the trigger 120 is squeezed to actuate a dispenser valve, a user's hand pressure required to actuate the valve is reduced by a factor of four relative to a trigger that has the same mechanical advantage but only accommodates one of the user's fingers. Finally, the trigger 120 is spaced and oriented relative to the cap 118 to comfortably accommodate a user's fingers between the trigger 120 and a can 130 to which the attachment 110 is attached. Preferably, the space between the trigger 120 and can 130 is sufficient to accommodate four fingers of a user when wearing a glove.

Each coupling cap 118 has a closed upper end and an open lower end defined by a rim 126 that protrudes radially outward from the lower end of the cap 118. The closed upper end can be integrally molded with the remainder of the cap 118, though to facilitate fabrication by injection molding the upper end is preferably closed by a separately molded panel 125 that provides a convenient location for labels or any other suitable type of indicia for the attachment 110. Similarly, the neck 116 and upper end of the grip 114 can be provided with areas for the attachment of labels or other indicia.

Similar to the attachment 10 of FIGS. 1 and 2, the rim 126 of each cap 118 in FIGS. 3 and 4 has a C-shaped configuration. As most readily evident from FIG. 5, the C-shape of the rim 126 defines a base 133 and a pair of ends 135 separated by a circumferential gap 127 that is contiguous with a window 134 formed at the front of the cap 118. A pair of slots 128 are defined in the rim 126 that, in combination with the configuration of the rim 126, enable the cap 118 to snap onto and grip the outer circumference of a valve mounting cup, such as that of the spray can 30 depicted in FIG. 1. Also similar to FIGS. 1 and 2, with the exception of the gap 127, the rim 126 defines a flange 136 that extends radially inward to define a central circular opening 138 at the lower extent of the rim 126. The flange 136 is configured to grip the outer diameter of a valve mounting cup, and the opening 138 defined by the flange 136 is sized to provide an interference fit with a valve mounting cup (outer diameter of about 1.270 inches; about 32 mm) of a conventional aerosol spray can, though it is foreseeable that the opening 138 could be sized and configured to engage other features of various types of spray cans. As evident from FIGS. 3 and 4, the flange 136 does not have the same axial extent (thickness) as the axial extent (axial thickness) of the rim 126 on the exterior of the cap 118, but instead has an axial thickness that is less than the axial thickness of the rim 126. In FIGS. 3 and 4, the axial thickness of the flange 136 is shown as being limited to less than half of the axial thickness of the rim 126, and more particularly roughly one-fourth the axial thickness of the rim 126. As also seen in FIGS. 3 and 4, the flange 136 is preferably located at the lower extremity of the rim 126.

Figure 5:
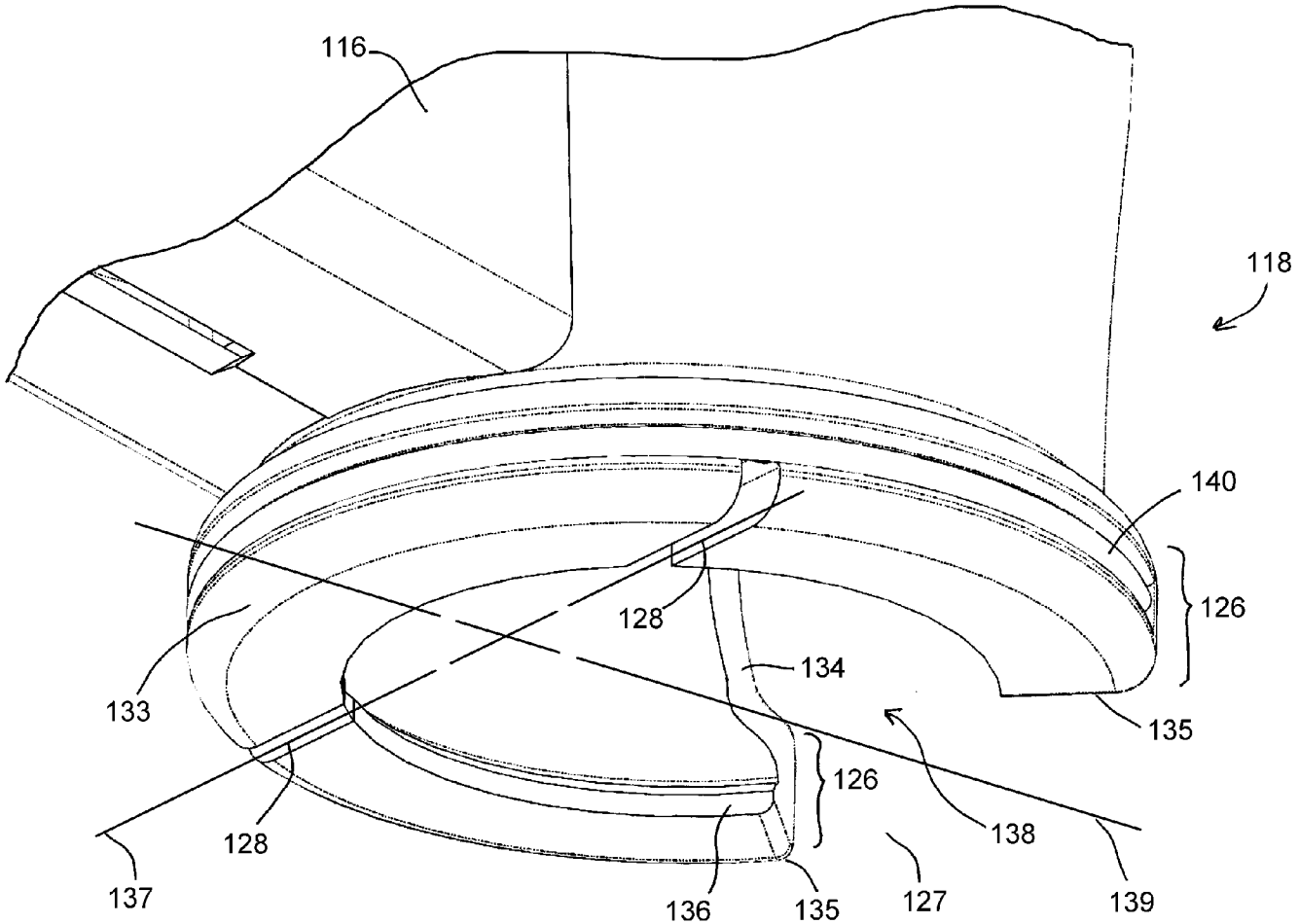
FIG. 5 is a perspective view showing the lower end of the coupling cap of the embodiment shown in FIG. 3.

The slots 128 of each cap 118 are preferably similarly configured to the slots 28 of the attachment 10 of FIGS. 1 and 2. As such, the slots 128 are preferably located approximately ninety degrees from each other and from the circumferential gap 127 in the circumferential direction, and the slots 128 pass entirely through the flange 136 of its rim 126, though not entirely through the rim 126 itself so that the rim 12 is able to contribute considerable rigidity to the lower end of the cap 118. Furthermore, and as represented in FIG. 5, the slots 128 are oriented to be roughly collinear with each other, perpendicular to an axis of symmetry 139 (FIG. 5) of the rim 126, and lie on a nondiametrical chord 137 located roughly midway between the base 133 of the rim 126 (diametrically opposite the gap 127) and a diametrical chord perpendicular to the rim's axis of symmetry 139. As such, each slot 128 is closer to the base 133 of the rim 126 than to the ends 135 of the rim 126 separated by the rim gap 127.

The rim 126 and its slots 128 provide a resilient compression or capture feature that enables each of the attachments 110 to be readily snapped onto a valve mounting cup and thereafter remain secured during use of the attachment 110 to dispense the contents of a spray can. More particularly, the slots 128 enable the lower portion 126A of the rim 126 (in which the slots 128 and flange 136 are defined) to deflect radially outward relative to the remaining upper extent of the rim 126 (above the slots 128). Consequently, flexure of the cap 118 and its rim 126 is predominantly localized in the lower portion 126A of the rim 126 in which the slots 128 and flange 136 are defined.

As noted above, each of the handle attachments of FIGS. 3 and 4 further incorporates a supplemental feature that promotes a secure fit and function for aerosol cans having net weights of eighteen ounces (510 grams) or more. Notably, each of these supplemental features is at least partially located in portions of the cap 118 outside the lower portion 126A of the rim 126 in which the slots 128 and flange 136 are defined. In the embodiment of FIG. 3, this supplemental feature is represented as a C-shaped ring 140 placed in a circumferential groove 142 surrounding the rim 126 of the attachment 110. The ring 140 preferably has a complementary shape to the C-shaped configuration of the rim 126, in which a free opening in the ring is aligned with the circumferential gap 127 of the rim 126. While the ring 140 could be fabricated particularly for use with the attachment 110, commercially-available "C" snap rings having round wire constant-sections can be employed by the invention. "C" snap rings are commonly formed of carbon spring steel wire material (SAE 1060-1075) whose Rockwell Scale Hardness (Rc) is in a range of about 42 to 48.

As evident from a perspective view of the lower end of the cap 118 in FIG. 5, the ring 140 and its groove 142 intersect the slots 128 defined in the flange 136 of the rim 126. In the embodiment shown in FIGS. 3 and 5, only the lower edge of the groove 142 intersects the upper extent of each slot 128, such that the groove 142 and ring 140 are predominantly above and outside the lower portion 126A of the rim 126 in which the slots 128 and flange 136 are defined. Consequently, as should also be evident from FIG. 5, the ring 140 does not serve as a hinge at the locations where its groove 142 intersects the slots 128. Instead, the ring 140 further contributes to the rigidity of the rim 126 above its lower portion 126A.

In the embodiment of FIG. 4, the supplemental feature is an increased wall thickness of the cap 118 that further contributes to the rigidity of the rim 126 above its lower portion 126A, which was determined to be capable of increasing the gripping force of the lower portion 126A of the rim 126. The increased wall thickness is preferably selectively created within interior of the cap 118 by increasing the axial extent of an interior shoulder 144 that can be seen in FIG. 3 as extending just beyond the upper extent of the rim 126, but seen in FIG. 4 as extending well into the upper half of the cap 118. In FIG. 4, the shoulder 144 is shown as extending up to a slot 146 defined within an upper region of the cap 118 to serve as a retention feature for the panel 125 that closes the upper end of the cap 118. However, in certain embodiments of the invention the shoulder 144 and the increased wall thickness that it provides extends to the top edge of the cap 118. The shoulder 144 is not required to cover or extend entirely around an inner circumference of the cap 118 (excluding the window 134), but instead can be limited to circumferential regions of each lateral half of the cap 118, for example, as shown for the right lateral half of the cap 118 in FIG. 4, in which case the left lateral half of the cap 118 preferably has an identical shoulder 144 to achieve symmetry of the cap 118 about the axis of symmetry 139 of the rim 126. Alternatively, the shoulder 144 can be further limited to just one lateral half of the cap 118, for example, the right lateral half of the cap 118 seen in FIG. 4. The shoulder 144 preferably increases the local thickness of the cap 118 above the rim 126 by about 25 to 50 percent, for example, about one-third to effectively serve as a reinforcement wall for the cap 118. As evident from FIGS. 4 and 6, the cap 118 can be configured to include both supplemental features of this invention, namely, the shoulder 144 as well as a groove 142 for receiving a ring 140.

In preferred embodiments, the cap 118 is integrally formed with one of the halves of the housing assembly 112, in which case the other housing half is simultaneously connected to the cap 118 when the halves are assembled to form the housing assembly 112. The housing half that includes the cap 118 can be manufactured to have a shoulder 144 whose axial extent within the cap 118 can be tailored to provide a desired gripping capability at the rim flange 136. In this manner, multiple versions of the spray can handle attachment 110 can be manufactured. For example, a single version of the housing half that does not include the cap 118 can be assembled with any one of a plurality of housing halves that include the cap 118 but have shoulders 144 of different axial lengths, so that an attachment 110 can be specifically assembled for a weight of a can for which the attachment 110 is intended to be used.

Figure 6:
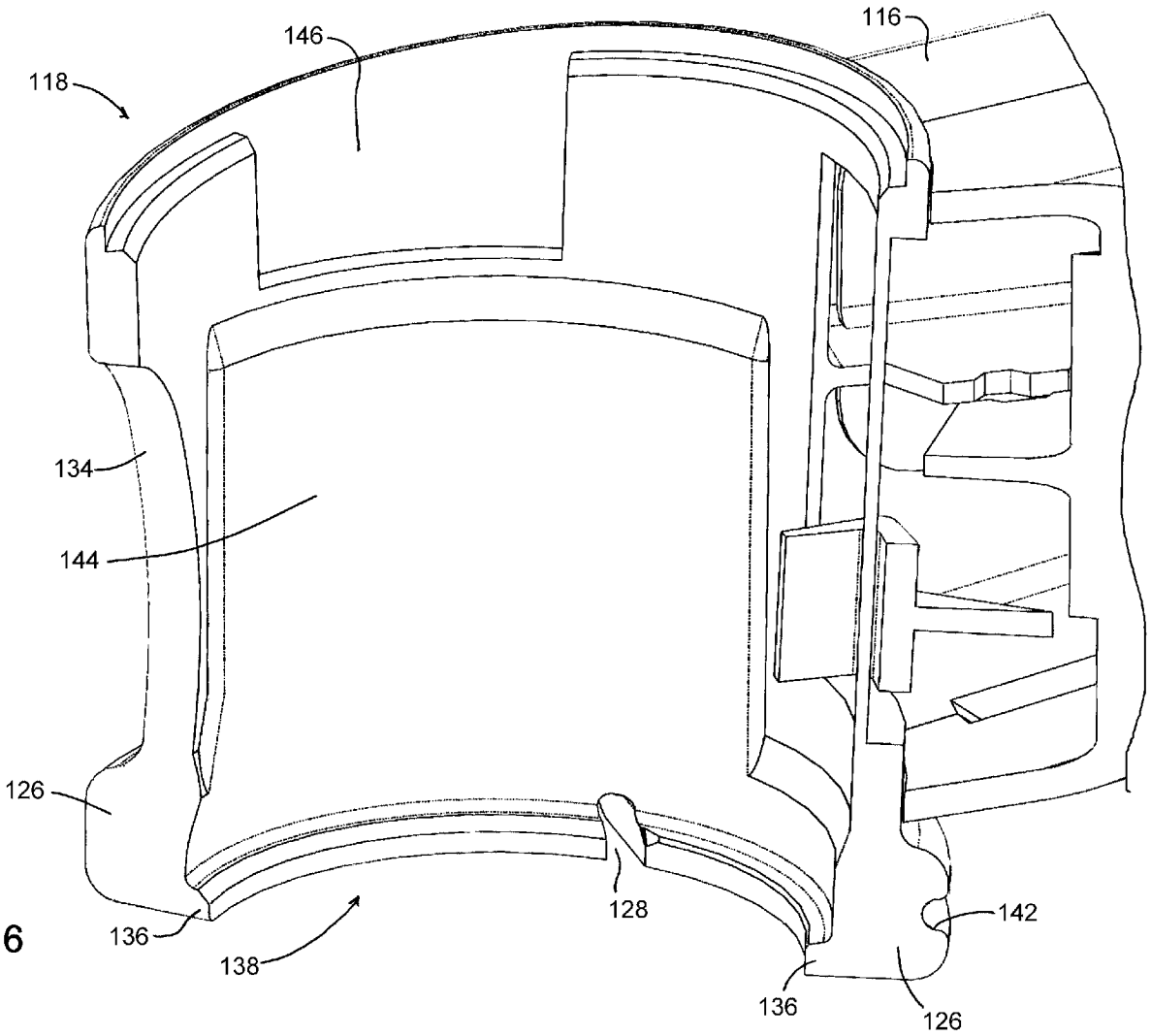
FIG. 6 is a perspective sectional view of the coupling cap of the embodiment shown in FIG. 4.

During investigations leading to the present invention, attachments 110 similar to those shown in FIGS. 3 and 4 were produced and equipped with either a round wire constant-section "C" snap ring of FIGS. 3 and 5 or the reinforcement shoulder 144 of FIGS. 4 and 6. In each case, the attachments were easily installed on and removed from a variety of aerosol spray cans, yet also provided a very secure attachment for lifting the spray cans, which included cans with weights ranging from 18 ounces up to 32 ounces (about 510 to about 1020 grams). From these results, it was concluded that the attachments could also be used to securely lift and operate spray cans whose net weights exceed 32 ounces (1020 grams).

While the invention has been described in terms of specific embodiments, it is apparent that other forms could be adopted by one skilled in the art. For example, the attachments could differ in appearance and construction from the embodiments shown in the figures, and materials and processes other than those noted could be used. Therefore, the scope of the invention is to be limited only by the following claims.

The invention claimed is:

1. A spray can handle attachment adapted for coupling to a valve mounting cup of a spray can and actuating a dispenser valve of the spray can, the spray can handle attachment comprising:

a housing defining a grip;

a cap coupled to the housing, the cap having an interior, an upper end, a lower end that defines an opening to the interior of the cap, a C-shaped rim that surrounds the opening and protrudes radially outward from the lower end of the cap, and an upper extent between the rim and the upper end of the cap, the rim having an axis of symmetry, a base located on the axis of symmetry, and a circumferential gap located on the axis of symmetry diametrically opposite the base and separating two ends of the rim, the opening being sized to accommodate an outer diameter of the valve mounting cup, the rim having a lower portion in which a flange and slots are defined, the flange extending radially inward to define the opening of the cap and being continuous except for the circumferential gap and the slots, the slots comprising first and second slots that are disposed on opposite sides of the axis of symmetry of the rim and lie on a chord that is perpendicular to the axis of symmetry, the flange having an interference fit with the valve mounting cup, the slots enabling the lower portion of the rim to deflect radially outward relative to the upper extent of the cap above the rim;

an actuation device pivotally mounted to the housing, the actuation device having a trigger portion disposed adjacent the grip and a finger portion that projects into the cap for actuating the dispenser valve of the spray can in response to movement of the trigger portion relative to the grip of the housing; and means for increasing the rigidity of the rim above the lower portion thereof, the rigidity increasing means comprising first and second shoulders within the interior of the cap and disposed on opposite sides of the axis of symmetry of the rim, the first and second shoulders increasing a local wall thickness within the upper extent of the cap above the rim and above, respectively, the first and second slots in the flange to increase a gripping force of the lower portion of the rim.

2. The spray can handle attachment according to claim 1, wherein the slots pass entirely through the flange of the rim but not entirely through the rim.

3. The spray can handle attachment according to claim 1, wherein the first and second slots are collinear and disposed between the base and a diametrical chord perpendicular to the axis of symmetry and wherein the chord on which the first and second slots lie is a nondiametrical chord perpendicular to the axis of symmetry of the rim.

4. The spray can handle attachment according to claim 1, wherein the slots consist of the first and second slots.

5. The spray can handle attachment according to claim 1, wherein the cap comprises a window sized to permit a spray emitted by the dispenser valve to exit the cap when the cap is coupled to the valve mounting cup.

6. The spray can handle attachment according to claim 1, wherein the circumferential gap of the rim is contiguous with a window that is defined in the cap and sized to permit a spray emitted by the dispenser valve to exit the cap when the cap is coupled to the valve mounting cup.

7. The spray can handle attachment according to claim 1, wherein the rim has an axial thickness on an exterior of the cap, the flange has an axial thickness on an interior of the cap, and the axial thickness of the flange is less than half the axial thickness of the rim.

8. The spray can handle attachment according to claim 7, wherein the first and second shoulders do not extend entirely around an inner circumference of the cap, the first shoulder is located in one lateral half of the cap, and the second shoulder is located in a remaining lateral half of the cap.

9. The spray can handle attachment according to claim 1, wherein the rigidity increasing means further comprises a ring that compresses the rim above the lower portion thereof.

10. The spray can handle attachment according to claim 1, wherein the rigidity increasing means enables the attachment to securely lift and operate a spray can whose net weight exceeds 510 grams.

11. The spray can handle attachment according to claim 1, wherein the rigidity increasing means enables the attachment to securely lift and operate a spray can whose net weight exceeds 1020 grams.

12. The spray can handle attachment according to claim 1, wherein the housing comprises housing halves that are assembled together.

13. The spray can handle attachment according to claim 12, wherein the cap is integrally formed with at least one of the housing halves.

14. A method of using the spray can handle attachment of claim 1, the method comprising:

installing the attachment on the valve mounting cup of the spay can so that the opening of the rim receives the outer diameter of the valve mounting cup and the flange of the rim has an interference fit with the valve mounting cup;

lifting the spray can with the grip of the attachment; and actuating the dispenser valve of the spray can by moving the trigger portion relative to the grip;

wherein the spray can has a net weight that exceeds 510 grams.

15. A spray can handle attachment coupled to a valve mounting cup of a spray can for actuating a dispenser valve of the spray can, the spray can handle attachment comprising:

a housing defining a grip;

a cap coupled to the housing, the cap having an interior, an upper end, a lower end that defines an opening to the interior of the cap, a C-shaped rim that surrounds the opening and protrudes radially outward from the lower end of the cap, and an upper extent between the rim and the upper end of the cap, the rim having an axis of symmetry, a base located on the axis of symmetry, and a circumferential gap located on the axis of symmetry diametrically opposite the base and separating two ends of the rim, the opening being sized to receive an outer diameter of the valve mounting cup, the rim having a lower portion in which a flange and slots are defined, the flange having an interference fit with the valve mounting cup, the slots enabling the lower portion of the rim to deflect radially outward relative to the upper extent of the cap above the rim;

an actuation device pivotally mounted to the housing, the actuation device having a trigger portion disposed adjacent the grip and a finger portion that projects into the cap for actuating the dispenser valve of the spray can in response to movement of the trigger portion relative to the grip of the housing; and means for increasing the rigidity of the rim above the lower portion thereof, the rigidity increasing means comprising shoulders within the interior of the cap and disposed on opposite sides of the axis of symmetry of the rim, the shoulders locally defining increased wall thicknesses within the upper extent of the cap above the rim and above the first and second slots in the flange to increase a gripping force of the lower portion of the rim.

16. The spray can handle attachment according to claim 15, wherein the slots pass entirely through the flange of the rim but not entirely through the rim.

17. The spray can handle attachment according to claim 15, wherein the slots consist of two collinear slots that are disposed between the base and a diametrical chord perpendicular to the axis of symmetry and that lie on a nondiametrical chord perpendicular to the axis of symmetry of the C-shaped rim.

18. The spray can handle attachment according to claim 15, wherein the rim has an axial thickness on an exterior of the cap, the flange has an axial thickness on an interior of the cap, and the axial thickness of the flange is less than half the axial thickness of the rim.

19. The spray can handle attachment according to claim 18, wherein the shoulders do not extend entirely around an inner circumference of the cap.

20. The spray can handle attachment according to claim 19, wherein the shoulders comprise a first shoulder located in one lateral half of the cap and an identical second shoulder located in a remaining lateral half of the cap.

* * * * *